US010233411B2

(12) United States Patent
Hoefte et al.

(10) Patent No.: US 10,233,411 B2
(45) Date of Patent: Mar. 19, 2019

(54) DIRECT-FOAM CLEANING PRODUCTS COMPRISING A BRANCHED ANIONIC SURFACTANT AND GLYCOL ETHER SOLVENT

(71) Applicant: The Procter & Gamble Company, Cincinnati, OH (US)

(72) Inventors: Paulus Antonius Augustinus Hoefte, Astene (BE); Jean-Luc Philippe Bettiol, Etterbeek (BE); Wesley Yvonne Pieter Boers, Antwerp (BE); Emilie Hourcade, Ixelles (BE); Peter Vancampenhout, Berg (BE); Olga Lahuerta Salas, Singapore (SG); Suxuan Gong, Beijing (CN); Gang Wu, Beijing (CN); Xu Li, Beijing (CN); Hilal Sahin Topkara, Zaventem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/334,512

(22) Filed: Oct. 26, 2016

(65) Prior Publication Data

US 2017/0121653 A1 May 4, 2017

(30) Foreign Application Priority Data

Oct. 30, 2015 (CN) ..... 2015/093322

(51) Int. Cl.

| | |
|---|---|
| ***C11D 1/94*** | (2006.01) |
| ***C11D 11/00*** | (2006.01) |
| ***C11D 3/43*** | (2006.01) |
| ***C11D 3/20*** | (2006.01) |
| ***C11D 1/66*** | (2006.01) |
| ***C11D 17/00*** | (2006.01) |
| ***C11D 1/83*** | (2006.01) |
| ***C11D 3/00*** | (2006.01) |
| ***C11D 17/04*** | (2006.01) |
| ***B05B 11/00*** | (2006.01) |
| *C11D 1/29* | (2006.01) |
| *C11D 1/14* | (2006.01) |
| *C11D 1/72* | (2006.01) |
| *C11D 1/75* | (2006.01) |
| *B05B 1/34* | (2006.01) |

(52) U.S. Cl.

CPC ..... *C11D 11/0023* (2013.01); *B05B 11/304* (2013.01); *C11D 1/66* (2013.01); *C11D 1/83* (2013.01); *C11D 1/94* (2013.01); *C11D 3/0094* (2013.01); *C11D 3/2068* (2013.01); *C11D 3/43* (2013.01); *C11D 11/0058* (2013.01); *C11D 17/0043* (2013.01); *C11D 17/041* (2013.01); *B05B 1/3436* (2013.01); *C11D 1/146* (2013.01); *C11D 1/29* (2013.01); *C11D 1/72* (2013.01); *C11D 1/75* (2013.01)

(58) Field of Classification Search

CPC ..... C11D 11/0023; C11D 1/90; C11D 1/94; C11D 1/75; C11D 1/29; C11D 1/12

See application file for complete search history.

(56) References Cited

U.S. PATENT DOCUMENTS

| | | | | |
|---|---|---|---|---|
| 3,914,185 | A | 10/1975 | Inamorato | |
| 5,872,088 | A * | 2/1999 | Pucci | C11D 1/83 510/238 |
| 6,482,793 | B1 * | 11/2002 | Gordon | C11D 1/8255 134/25.2 |
| 6,484,735 | B1 * | 11/2002 | Gordon | C11D 1/72 134/25.2 |
| 2003/0045439 | A1 * | 3/2003 | Evers | C11D 1/83 510/238 |
| 2004/0254085 | A1 | 12/2004 | Rouillard et al. | |
| 2006/0094619 | A1 * | 5/2006 | Billman | C11D 1/825 510/284 |
| 2008/0066788 | A1 * | 3/2008 | Riou | C11D 3/2086 134/42 |
| 2009/0305941 | A1 * | 12/2009 | Diet | C11D 1/146 510/422 |
| 2011/0180619 | A1 * | 7/2011 | Konishi | A47L 13/26 239/1 |
| 2012/0234352 | A1 * | 9/2012 | Konishi | A47L 13/26 134/8 |
| 2012/0258904 | A1 * | 10/2012 | Bjelopavlic | C11D 3/1233 510/397 |

(Continued)

FOREIGN PATENT DOCUMENTS

| | | | |
|---|---|---|---|
| CN | 102803461 | A | 11/2012 |
| EP | 1586263 | A2 | 10/2005 |

(Continued)

OTHER PUBLICATIONS

International Preliminary Report on Patentability for International Application Serial No. PCT/CN2015/093322, dated May 11, 2018, 7 pages.

*Primary Examiner* — Charles I Boyer

(74) *Attorney, Agent, or Firm* — Dara M. Kendall

(57) ABSTRACT

A direct-foam cleaning product comprising a foam having a compression force of about 2.4 gf*mm to about 4.3 gf*mm. Such direct-foam cleaning product provides good foaming properties and surface coverage when the composition is sprayed directly onto soiled dishware. This leads to efficient cleaning of soiled dishes via a direct-foam and rinse action, which avoids traditional methods of soaking soiled dishes in detergent baths and/or scrubbing soiled dishware with a sponge or cleaning implement.

9 Claims, 9 Drawing Sheets

(56) References Cited

U.S. PATENT DOCUMENTS

| | | | | |
|---|---|---|---|---|
| 2013/0112766 | A1 | 5/2013 | Maas et al. | |
| 2014/0014691 | A1* | 1/2014 | Foster | B05B 11/3011 222/383.1 |
| 2014/0039066 | A1 | 2/2014 | Grimadell et al. | |
| 2017/0121654 | A1 | 5/2017 | Hoefte et al. | |

FOREIGN PATENT DOCUMENTS

| | | | |
|---|---|---|---|
| WO | WO91017237 | A1 | 11/1991 |
| WO | WO9219713 | A1 | 11/1992 |

* cited by examiner

DIRECT-FOAM CLEANING PRODUCTS COMPRISING A BRANCHED ANIONIC SURFACTANT AND GLYCOL ETHER SOLVENT

FIELD OF THE INVENTION

The present invention relates to direct-foam cleaning products. More particularly, the present invention relates to direct-foam hand dishwashing cleaning products.

BACKGROUND OF THE INVENTION

Hand dishwashing is typically performed by applying dishwashing detergent to a sponge or cleaning implement and scrubbing dishware with the implement; or adding the detergent to a water bath in a sink and soaking/scrubbing the dishware in the detergent water bath. Such conventional methods may take the consumer longer periods of time than necessary to clean dishware when it is not heavily soiled or when there are only a few items to clean (e.g. knife, spatulas, soup ladles, etc used briefly to prepare food). Such conventional methods may also result in wasted dishwashing detergent product (i.e. dosed amount may be more than needed to clean the dishware).

Finding efficient ways of cleaning dishware may be desired by many consumers. One approach to quicker cleaning is direct application of dishwashing detergent onto the soiled dishware followed by an optional light scrub and then a water rinse. One attempt in the art of direct-foam cleaning is "Method Power Foam Dish Soap" dishwashing detergent sold by Methods Products (San Francisco, Calif., U.S.A.). The Method product provides a dishwashing composition in a spray bottle. Current direct-foam dishwashing products, however, may not effectively clean dishware and may not provide good surface area foam coverage and/or lasting foam coverage for efficient cleaning. To compensate for the lack of coverage and non-lasting coverage, multiple spray actions are needed which can negatively affect user experience, lead to overconsumption of the cleaning product, and may also increase product bounce back from surfaces when spraying. Such bounce back can cause wasted product and possible product inhalation risks.

As such, it is desirable to improve cleaning efficiency by providing good coverage on surfaces per dose of the direct-foam cleaning product with minimal bounce back and without compromising tough food cleaning.

SUMMARY OF THE INVENTION

The invention comprises a direct-foam cleaning product comprising a cleaning composition comprising from about 5% to about 15%, by weight of said composition, of a surfactant system and an effective amount of a organic grease cleaning solvent; wherein said cleaning composition is formulated to provide a foam when dispensed from a spray dispenser, and wherein said foam comprises a compression force from about 2.4 gf*mm to about 4.3 gf*mm.

There is also provided a direct-foam cleaning product comprising a pre-compression spray dispenser; a cleaning composition comprising from about 5% to about 15%, by weight of said composition, of a surfactant system; wherein said spray dispenser is configured to spray said composition and provide a foam comprising a compression force from about 2.4 gf*mm to about 4.3 gf*mm, a foam density from about 0.08 g/ml to about 0.3 g/ml, and wherein said foam defines an overall area from about 20 $cm^2$ to about 90 $cm^2$ and a central area from about 30 $cm^2$ to about 60 $cm^2$.

There is also provided a direct-foam cleaning product comprising a cleaning composition comprising from about 5% to about 15%, by weight of said composition, of a surfactant system comprising an anionic surfactant and a co-surfactant; and an effective amount of an organic grease cleaning solvent comprising a glycol ether solvent selected from the group consisting of: glycol ethers of Formula I: R1O(R2O)nR3; Formula II: R4O(R5O)mR6; and mixtures thereof; wherein R1 is a linear or branched C4, C5 or C6 alkyl or a substituted or unsubstituted phenyl, R2 is ethyl or isopropyl, R3 is hydrogen or methyl and n is 1, 2 or 3, R4 is n-propyl or isopropyl, R5 is isopropyl, R6 is hydrogen or methyl and m=1, 2 or 3, and wherein said surfactant system and said glycol ether solvent are present in said composition in a weight ratio from about 5:1 to about 1:1; wherein said cleaning composition is formulated to provide a foam when dispensed from a spray dispenser, and wherein said foam comprises a compression force from about 2.4 gf*mm to about 4.3 gf*mm.

BRIEF DESCRIPTION OF THE DRAWINGS

Further features of the invention are set forth in the following detailed description of the invention and in the drawing figures.

DETAILED DESCRIPTION OF THE INVENTION

The direct-foam cleaning product of the present invention includes a cleaning composition dispensed from a spray dispenser to form a direct-foam. A "direct-foam" or "direct-product", as used herein, is a product that forms a foam on the surface to which it is applied, without requiring additional physical, chemical, or like interventions. For example, manual rubbing of a product on a surface to produce a foam once the product is dispensed from its container is not a direct-foam product. The direct foam product is applied to the surface directly from the container in which it was stored.

Figure 1A:
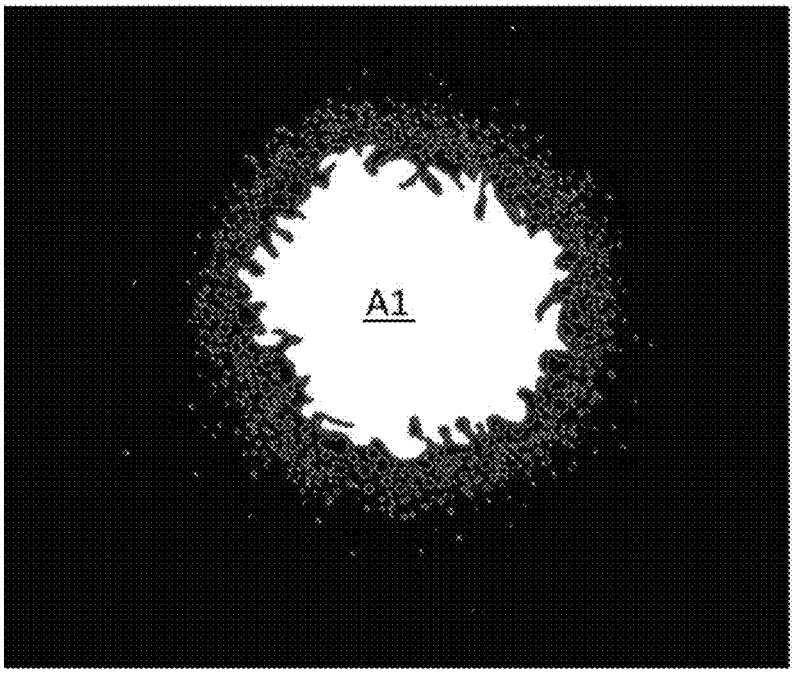
FIGS. 1A and 1B are scanned images of a direct-foam spray pattern, highlighting defined areas of the foam pattern, according to the present invention.
Figure 1B:
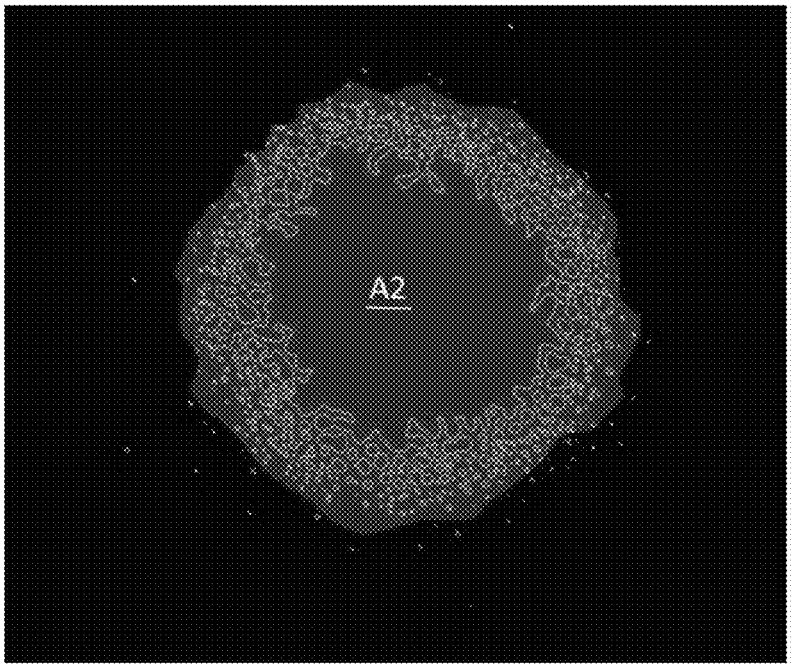

The cleaning composition can be dispensed from a pre-compression sprayer or an aerosol sprayer with a pressure control valve, both commercially available in the art. Suitable pre-compression sprayers in which a buffer mechanism to control the maximum pressure can be added include the Flairosol® spray dispenser, manufactured and sold by Afa Dispensing Group (The Netherlands) and the pre-compression trigger sprayers described in U.S. Patent Publication Nos. 2013/0112766 and 2012/0048959. A "pre-compression sprayer", as used herein, is a sprayer with a pre-compression valve to control the minimum pressure required for liquid to release from the trigger sprayer and a buffer mechanism to control the maximum pressure of liquid being pumped to the buffer chamber. It is also contemplated that the cleaning composition may be dispensed from a conventional trigger sprayer. When the composition is dispensed from a pre-compression sprayer, the cleaning composition provides a direct-foam product having a wide ring-like foam pattern. While FIGS. 1A and 1B show the ring-like foam pattern of one direct-foam cleaning product, other foam pattern shapes are contemplated and can be achieved through modifications of the nozzle design.

Figure 2:
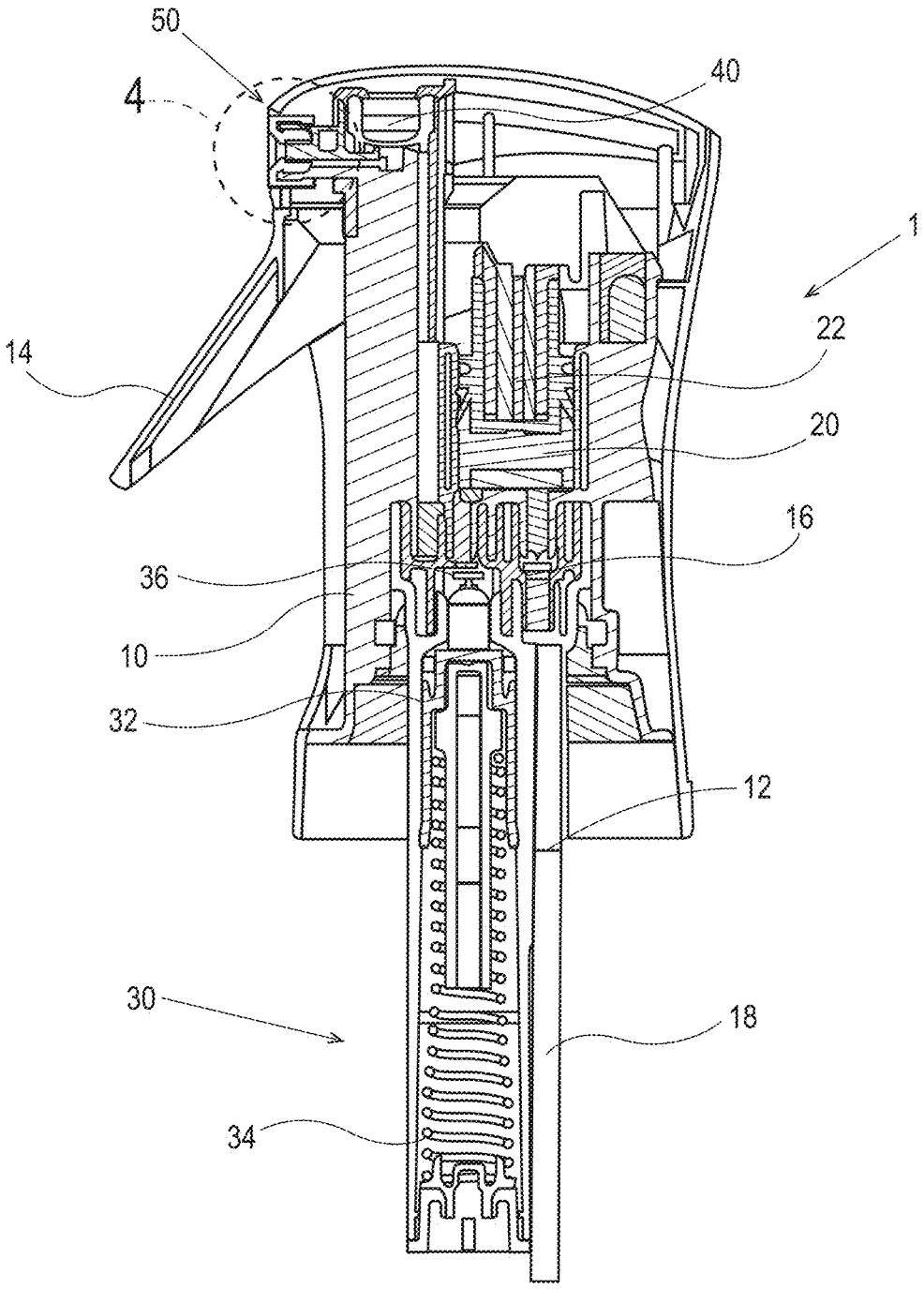
FIG. 2 is a cross sectional view of a pre-compression trigger sprayer with buffer mechanism.
Figure 3:
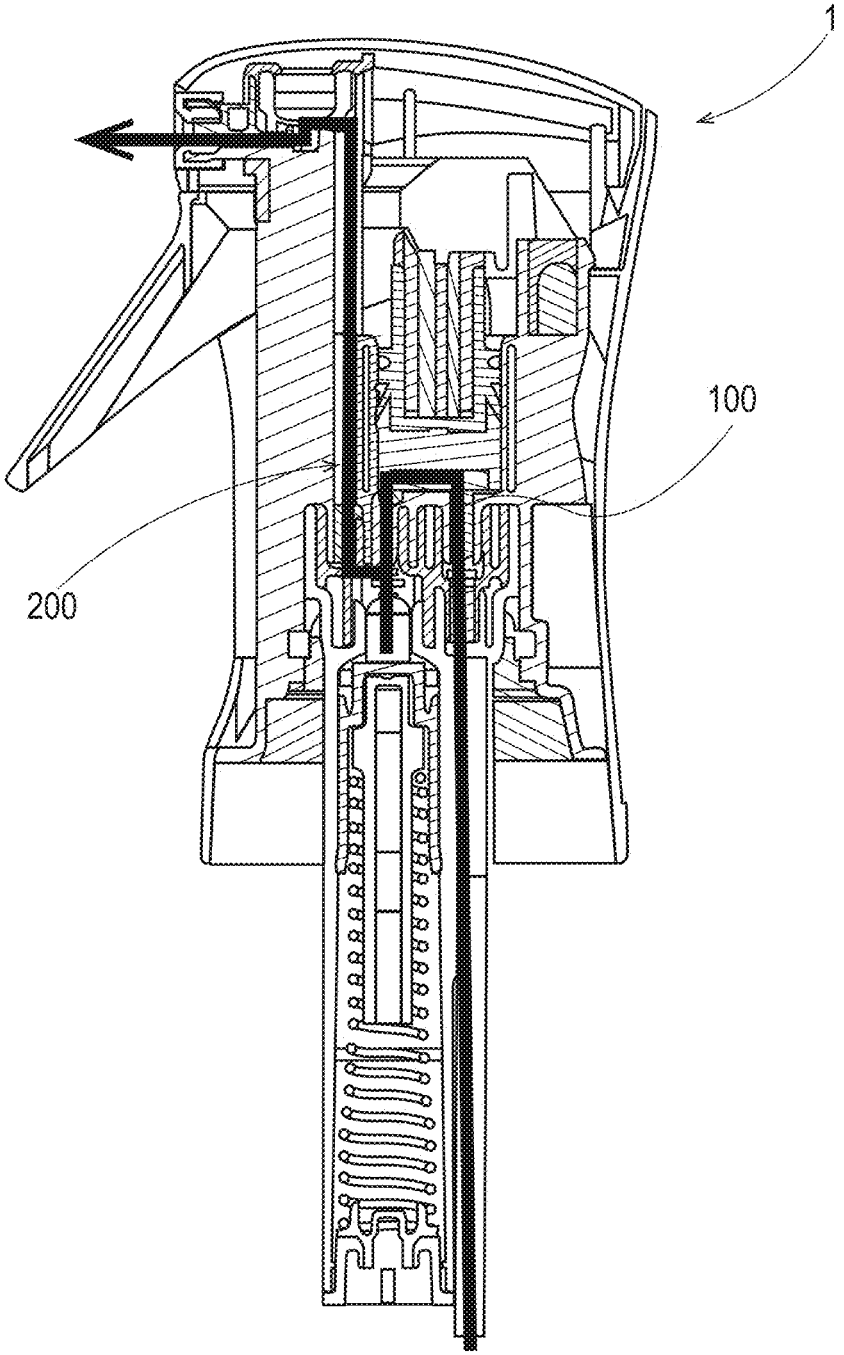
FIG. 3 shows the liquid flow path of the pre-compression trigger sprayer with buffer mechanism in FIG. 2.

Referring to FIG. 2, a pre-compression sprayer 1, from which a direct-foam cleaning composition of the present invention may be dispensed, is shown. The pre-compression sprayer 1 includes a spray engine frame 10 that fluidly connects a liquid inlet 12 to a compression chamber 20, a buffer chamber 30, a pre-compression valve 40, and nozzle 50. The liquid composition 100 travels through the flow path 200 shown in FIG. 3 and is dispensed as a direct-foam product. The liquid inlet 12 may fluidly connect to an optional diptube 18 to draw liquid composition 100 from a bottle or reservoir (not shown) through the flow path 200 of the sprayer 1. The bottle and liquid composition 100 may be separately sold or provided as a refill for the direct-foam cleaning product. Liquid composition 100 from the reservoir can also be drawn into the sprayer 1 without the diptube 18 using, for example, known airless systems with a collapsible inner structure, like bag-in-bottle, delaminating bottles like the Flair® bottle technology manufactured and sold by Afa Dispensing Group (The Netherlands), tubes with follower pistons, collapsible pouches, cans with bag on valve systems, and other airless technologies know in the art.

The pre-compression sprayer 1 may include an actuation element, such as a trigger 14 as shown in FIG. 2, or another known actuation element (e.g. push button, etc.), which is mechanically connected to a piston 22. In operation, when the spring loaded trigger 14 is actuated by a user, the piston 22 moves down and, when the trigger 14 is released, the force of the spring moves the piston 22 back up. This expands the volume of the chamber and generates an under-pressure that opens the inlet valve 16 and closes the outlet valve 36 and causes the liquid composition 100 to be sucked up into the compression chamber 20. As the inlet valve 16 opens, the outlet valve 36 closes (the under pressure moves the outlet valve upwards into a closed position).

When the trigger 14 is actuated or pulled in by a user, it creates a down stroke in the compression chamber 20. The piston 22 moves down and pushes liquid into the buffer chamber 30 towards the pre-compression valve 40. The inlet valve 16 closes and the outlet valve 36 opens, thus letting the liquid composition 100 pass to the buffer chamber 30 and to the pre-compression valve 40 (pressure moves it downwards into its open position). When the trigger 14 is actuated, the inlet valve 16 closes, preventing the liquid from the compression chamber 20 being pushed back into the bottle/reservoir (pressure moves it downwards into closed position).

The pressure of the liquid composition 100 in the buffer chamber 30 pushes down on the buffer piston 32, and the buffer spring 34 underneath the buffer piston 32 is thereby compressed, thus allowing liquid composition temporarily to be stored under pressure (pressurized) in the buffer chamber 30. There is an overflow valve (not shown) at a certain depth of the buffer chamber 30. This is done to prevent too much build up of liquid pressure and, thus, is a kind of outlet at a certain defined point beyond which the buffer piston 32 cannot travel downward. Thus, when the buffer piston 32 moves beyond a certain point (at maximum desired pressure/spring force), liquid will flow back into the reservoir through an overflow valve in the buffer chamber 30. The liquid overflow valve can be set for a maximum buffer spring 34 pressure in the buffer chamber 30 of, for example, 0.5 to 3.0, or 0.5 to 1.0 bar, above the preset opening pressure of the pre-compression valve 40. In exemplary embodiments of the present invention, such pre-compression valve opening pressure can be, for example, 1.5, 2.5, 3.5 or even 6 bar or more. It is noted that in exemplary embodiments of the present invention, the pre-compression valve 40 has a lower opening pressure than the maximum pressure that can develop in the buffer chamber 30. In this way, the pre-compression valve 40 will open and spray can occur well before the buffer chamber 30 is fully filled with liquid and thus reaching its maximum pressure. This allows for continuous spray conditions. More particularly, when more liquid is available in the sprayer than the nozzle 50 can spray (the nozzle is restricted by the maximum flow rate through the nozzle), the remaining liquid is stored in the buffer chamber 30 and is gradually released over a certain time until the pressure drops below the pre-compression valve closing pressure which will shut off the liquid flow. This allows for long duration spraying with a single actuation and continuous spraying with multiple actuations at certain actuation intervals. For instance, if the nozzle 50 can only spray 1 ml/s and 1.4 ml of liquid is pumped in one actuation, the spray will continue for 1.4 seconds. If three actuations of 1.4 ml of liquid will be pumped in 2 seconds, the sprayer will continue spraying for 4.2 seconds.

The pre-compression valve 40 controls the spray action from the nozzle 50. The pre-compression valve 40 has a defined pressure; when the pressure of the liquid exceeds such defined pressure, the pre-compression valve opens and a spray results. When the pressure falls below the defined closing pressure of pre-compression valve 40, the pre-compression valve closes, thereby insuring that only properly pressurized liquids can proceed to the nozzle 50 an insure a continuous spray. The pre-compression valve 40 opens because of the liquid pressure in the buffer chamber 30, and the liquid composition 100 thus passes towards the nozzle 50 creating a desired spray.

When the trigger 14 is actuated, the inlet valve 16 also closes, preventing the liquid from the compression chamber 20 being pushed back into the bottle/reservoir (pressure moves it downwards into closed position). Although the pre-compression sprayer 1 may be in a subsequent trigger release and liquid intake step, liquid composition 100 can still pass by the pre-compression valve 40 and through the orifice 60 to continue the spray. It is in this manner that a user can cause a continuous spray—as long as the user continues to pump the trigger 14 such that the liquid intake strokes keeps up with the spray, liquid composition 100 continues to be drawn up and sent to the pressure chamber and the pre-compression valve. In this context, it is noted that by varying the relative volumes of the compression chamber 20 and the buffer chamber 30, various speeds of pumping can be designed.

Figure 4:
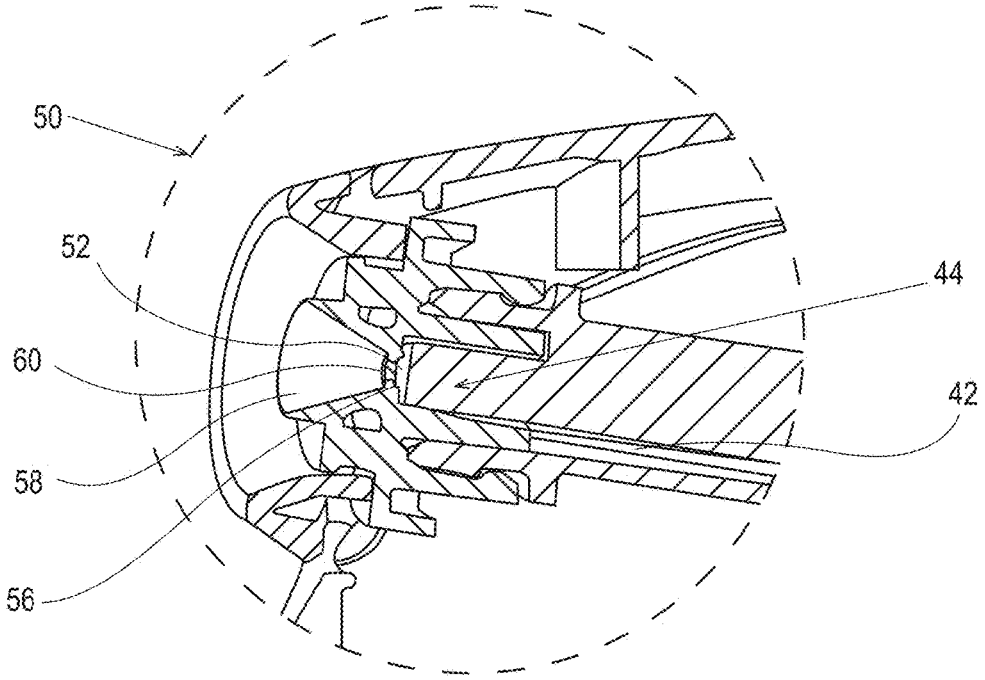
FIG. 4 is an enlarged cross sectional view of the spray nozzle defined by dashed boundary "4" shown in FIG. 3.

Referring now to FIG. 4, a nozzle 50 is shown having a liquid spinner shaft 44 positioned in the liquid discharge passage 42. The spinner shaft 44 leads to a swirl chamber 52 at one end adjacent the nozzle orifice 60. The spinner shaft 44 extends axially in the downstream direction to the orifice 60. The orifice 60 leads to a cone 58 which guides the spray angle of the liquid exiting the orifice 60.

Figure 5:
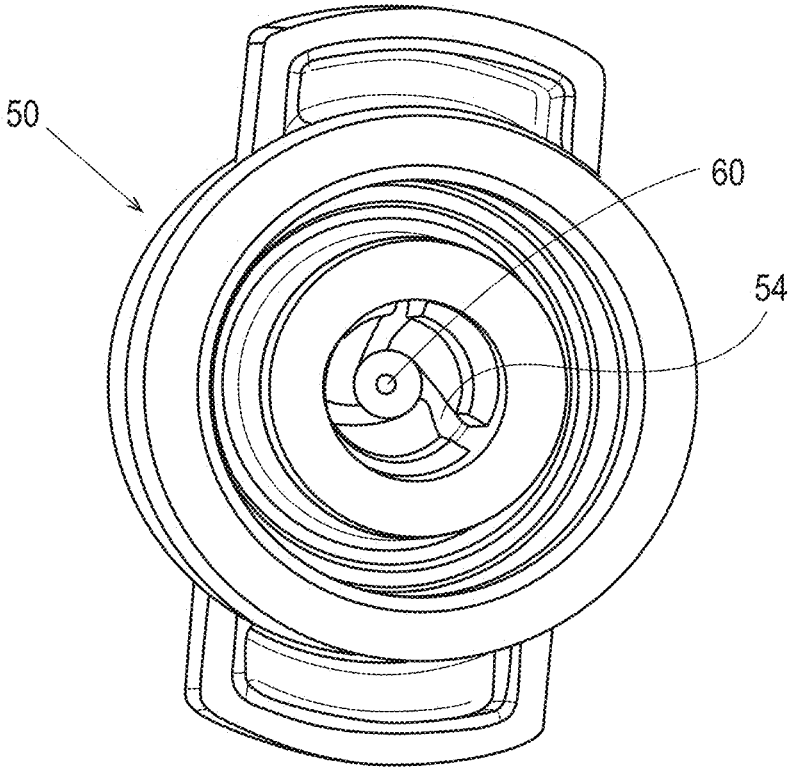
FIG. 5 is a front elevational view of a cut-away portion of the nozzle shown in FIG. 4.

Referring to FIG. 5, the nozzle 50 includes a plurality of spin grooves 54 and an orifice 60 which provides an exit path through the nozzle 50. The spin grooves 54 may be one to five, three to five, or three in count. On the inside of the nozzle 50, the spin grooves 54 guide the liquid into an inner cone 56 which ends at its narrow end into a short cylindrical orifice 60.

The spin grooves 54 can vary in shape, width and depth and can taper from wide to narrow to accommodate the best acceleration of the flow of the liquid with the least resistance and pressure drop. The inner cone 56 may have an angle of about 20° to about 120° and defines how much the spinning liquid is further accelerated before the orifice 60 and, as such, the spread or how wide the spray comes out of the orifice 60. The spin grooves 54 accelerate and swirl the liquid under pressure into the inner cone 56 where the gradual reduction in diameter compresses and accelerates the liquid further to spray it out under high pressure through the narrow orifice 60. The sudden pressure drop at the exit of the orifice 60 allows the compressed highly energized liquid to expand and breaks up the liquid into small droplets. The velocity, direction, and spray width of the sprayed droplets is defined by the energy and the trajectory introduced by the spin grooves 54 and the angle on the inner cone 56. The short cylindrical path in the orifice 60 should be kept as short as technically possible to not impact the width of the spray.

On the outside of the orifice 60 or downstream of the orifice, an external cone 58 is provided which guides the spray angle of liquid droplets exiting the orifice. This external cone 58 may have an angle of about 20° to about 120°, or about 100°. The sudden pressure drop at the exit generates an under pressure in the center of the spray. This under pressure will suck in air from the environment into the spray and the small droplets being formed at the exit turn into small foam bubbles. This effect is further enhanced by the external cone 58 which also guides the liquid stream outwards to further break up the spray into a wide foam spray pattern. The foam particles can be further tuned by introducing more air through additional venting holes in the external cone positioned close to the zone with the highest under pressure. Via the venturi effect this under pressure will suck in more air into the stream of droplets generating thicker, more pronounced foam.

The orifice 60 may be of constant diameter or may taper in the axial direction, widening in diameter as the spray travels from a proximal end (i.e. closest to the orifice 60 and the flow path 200) to a distal end of the nozzle 50. A constant orifice diameter may be about 0.10 mm to about 0.60 mm, or about 0.30 mm to about 0.40 mm, or about 0.32 mm to about 0.37 mm, or about 0.36 mm. When tapered, the orifice 60 may taper from a proximal end diameter of about 0.13 mm to a distal end diameter of about 1 mm to about 5 mm to a distal end diameter of about 0.10 mm to about 0.60 mm, or about 0.30 mm to about 0.40 mm.

Exemplary nozzle configurations are provided in Table 1.

TABLE 1

| Dual Nozzles | Parameters |
|---|---|
| Nozzle 1 | Orifice diameter: 0.35 mm<br>Inner cone angle: 100° |

TABLE 1-continued

| Dual Nozzles | Parameters |
|---|---|
| Nozzle 2 | Three swirl grooves: depth of grooves is 0.22 smallest pass<br>Trough of grooves: 0.25 mm<br>External cone angle: 100° with venting holes (to allow more air to be pulled into the cone)<br>Buffer pressure: 5.0 to 5.2 bar<br>Pre-compression valve pressure: 3.0 to 3.5 bar<br>Orifice diameter: 0.30 mm<br>Inner cone angle: 100°<br>Three swirl grooves; depth of grooves is 0.50 mm smallest pass<br>Trough of grooves: 0.25 mm<br>External cone angle: 100° with venting holes/<br>Buffer pressure: 5.0 to 5.2 bar<br>Pre-compression valve pressure: 3.0 to 3.5 bar |

Although particular aspects of the pre-compression sprayer 1 and nozzle 50 of the invention have been described above, it should be understood that other modifications and variations could be made to the trigger sprayer and nozzle without departing from the scope of the invention defined by the claims.

Cleaning Composition

The direct-foam cleaning product of the present invention comprises a cleaning composition comprising a surfactant system and, optionally, an organic grease cleaning solvent. The suds generated when spraying the cleaning composition of the invention are strong enough to withstand the impact force when the direct-foam cleaning product contacts the article to be washed (i.e. minimizes bounce back, inhalation, and product waste), but at the same time are easy to rinse. The direct-foam cleaning product of the invention provides good cleaning, including cleaning of tough food soils such as cooked-, baked- and burnt-on soils and good cleaning of light oily soils. The direct-foam cleaning product of the invention also provides good detergent spreading, requiring reduced scrubbing by the consumer.

Surfactant System

The cleaning composition comprises from about 5% to about 15%, or from about 6% to about 14%, or from about 7% to about 12%, by weight of the composition, of a surfactant system. The surfactant system may comprise an anionic surfactant. The surfactant system may also comprise a co-surfactant selected from the group consisting of amphoteric surfactants, zwitterionic surfactants, and mixtures thereof. The surfactant system can optionally comprise a non-ionic surfactant and/or a cationic surfactant.

The presence of small droplets (and therefore the risk of inhalation) is minimized when the surfactant system contains an anionic surfactant. Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group that may be selected from sulfonate, sulfate, and carboxylate so as to form a water-soluble compound. Usually, the hydrophobic group will comprise a linear or branched C8-C22 alkyl, or acyl group. Such surfactants are employed in the form of water-soluble salts and the salt-forming cation usually is selected from sodium, potassium, ammonium, magnesium and mono-, di- or tri-alkanolammonium.

The anionic surfactant may be a sulfate anionic surfactant. The sulfate anionic surfactant may be an alkoxylated sulfate anionic surfactant or an alkoxylated sulfate anionic surfactant having an average alkoxylation degree from about 2 to about 5, or about 3. It has been found that alkyl ethoxy sulfate with an average degree of ethoxylation from about 2 to about 4, or from about 3, performs well in terms of cleaning and speed of cleaning. When the sulfate anionic surfactant is a mixture of sulfate anionic surfactants, the average alkoxylation degree is the weight average alkoxylation degree of all the components of the mixture. In the weight average alkoxylation degree calculation, the weight of sulfated anionic surfactant components not having alkoxylate groups should also be included.

Weight average alkoxylation degree=
(x1*alkoxylation degree of surfactant
1+x2*alkoxylation degree of surfactant
2+ . . . )/(x1+x2+ . . . )

wherein x1, x2, . . . are the weights in grams of each sulfate anionic surfactant of the mixture and alkoxylation degree is the number of alkoxy groups in each sulfate anionic surfactant.

If the sulfate anionic surfactant is branched, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the present direct-foam product. The branched sulfate anionic surfactant can be a single anionic surfactant or a mixture of anionic surfactants. In the case of a single surfactant, the percentage of branching refers to the weight percentage of the hydrocarbyl chains that are branched in the original alcohol from which the surfactant is derived. In the case of a surfactant mixture, the percentage of branching is the weight average, and it is defined according to the following formula:

Weight average of branching (%)=[(x1*wt %
branched alcohol 1 in alcohol 1+x2*wt %
branched alcohol 2 in alcohol 2+ . . . )/(x1+
x2+ . . . )]*100 wherein x1, x2, are the weight in grams of each alcohol in the total alcohol mixture of the alcohols which were used as starting material for the anionic surfactant for the detergent of the invention.

In the weight average branching degree calculation, the weight of anionic surfactant components not having branched groups should also be included. When the surfactant system comprises a branched anionic surfactant, the surfactant system comprises at least 50%, or least 60%, or at least 70% of branched anionic surfactant by weight of the surfactant system; or the branched anionic surfactant comprises more than 50% by weight thereof of an alkyl ethoxylated sulfate having an average ethoxylation degree of from about 2 to about 5 and a level of branching of from about 5% to about 40%.

Suitable sulfate surfactants for use herein include water-soluble salts of C8-C18 alkyl, preferably C8-C18 alkyl comprising more than 50% by weight of the C8 to C18 alkyl of C12 to C14 alkyl or hydroxyalkyl, sulfate and/or ether sulfate. Suitable counterions include alkali metal cation, earth alkali metal cation, alkanolammonium or ammonium or substituted ammonium, or sodium. The sulfate surfactants may be selected from C8-C18 alkyl alkoxy sulfates (AExS) wherein x is from 1-30 in which the alkoxy group could be selected from ethoxy, propoxy, butoxy or even higher alkoxy groups and mixtures thereof. The sulfate surfactants may be C12-C14 alkyl ethoxy sulfate with an average degree of ethoxylation from about 2 to about 5, or about 3. Alkyl alkoxy sulfates are commercially available with a variety of chain lengths, ethoxylation and branching degrees. Commercially available sulfates include, those based on Neodol alcohols ex the Shell company, Lial-Isalchem and Safol ex the Sasol company, natural alcohols ex The Procter & Gamble Chemicals company.

If the anionic surfactant is branched, it is preferred that the branched anionic surfactant comprises at least 50%, or at least 60% or at least 70% of a sulfate surfactant, by weight of the branched anionic surfactant. From a cleaning view point, the anionic surfactants are those branched surfactants in which the branched anionic surfactant comprises more than 50%, or at least 60% or at least 70% by weight thereof of sulfate surfactant and the sulfate surfactant is selected from the group consisting of alkyl sulfate, alkyl ethoxy sulfates and mixtures thereof. Even more preferred are those in which the branched anionic surfactant has an average degree of ethoxylation of from about 2 to about 5, more preferably about 3 and even more preferably when the anionic surfactant has an average level of branching of from about 10% to about 35%, or from about 20% to 30%.

Another anionic sulfate surfactant are branched short chain alkyl sulfates. Such anionic sulfate surfactant have a linear alkyl sulfate backbone, the backbone comprising from 4 to 8, or from 5 to 7 carbon atoms, substituted with one or more C1-05 or C1-C3 alkyl branching groups in the C1, C2 or C3, or C2 position on the linear alkyl sulfate backbone. This type of anionic surfactant has been found to deliver strong grease cleaning as well as good foaming performance, especially immediate foaming performance upon spraying when the composition comprises amine oxide or betaine, as a co-surfactant. The sulfate group within the branched short chain alkyl sulfate surfactant is bonded directly to said C4-C8 linear backbone in terminal position. The linear alkyl sulfate backbone may comprise from 5 to 7 carbon atoms. The one or more alkyl branching groups are selected from methyl, ethyl, propyl or isopropyl. The branched short chain alkyl sulfate surfactant has only one branching group substituted on its linear backbone chain. The alkyl branching group may be on the C2 position in the linear alkyl sulfate backbone.

The branched short chain alkyl sulfate according to the current invention may have a linear alkyl backbone comprising from 5 to 7 carbons, substituted on the C2 position in the linear alkyl sulfate backbone with one alkyl branching group selected from methyl, ethyl, propyl. The branched short chain alkyl sulfate surfactant may be 2-ethylhexylsulfate. This compound is commercially available under the Syntapon EH tradename from Enaspol and Empicol 0585U from Huntsman. The branched short chain alkyl sulfate surfactant will be formulated from about 3% to about 10%, or from about 4% to about 8%, by weight of the composition. The branched short chain alkyl sulfate surfactant will be formulated from about 50% to about 100%, or from about 55% to about 75%, by weight of the total surfactant composition.

Co-Surfactant

The surfactant system may also comprise a co-surfactant selected from the group consisting of amphoteric surfactants, zwitterionic surfactants, and mixtures thereof. The amphoteric surfactant may be an amine oxide. "Co-surfactant" as used herein means a surfactant that is present in the composition in an amount lower than the main surfactant. "Main surfactant" as used herein means the surfactant that is present in the composition in the highest amount. The co-surfactant seems to help with the sudsing of the product.

Suitable amine oxides are alkyl dimethyl amine oxide, alkyl amido propyl dimethyl amine oxide, and coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the α carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein. The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Other suitable co-surfactants are zwitterionic surfactants. The zwitteronic surfactant may be a betaine surfactant, including alkyl betaine, alkyl amido propyl betaine, sulfo betaine, amido sulfo betaine, or more particularly, cocoamidopropylbetaine.

The anionic surfactant and the co-surfactant may be present in the composition of the present invention in a weight ratio from about 4:1 to about 1:1, or from about 3:1 to about 1:1, or from about 2.8:1 to about 1.3:1. An exemplary surfactant system may comprise: (1) about 4% to about 10%, or about 5% to about 8%, by weight of the composition, of an anionic surfactant, or an alkyl alkoxy sulfate surfactant, or a branched short chain alkyl sulfate; (2) about 1% to about 5%, or about 1% to about 4%, by weight of the composition, of a surfactant selected from the group consisting of amphoteric surfactant, zwitterionic surfactant, and mixtures thereof, or an amine oxide surfactant. It has been found that such surfactant system in combination with the organic grease cleaning solvent of the present invention provides excellent cleaning and a desirable foaming profile.

The surfactant system may optionally comprise commercially available non-ionic surfactants. Suitable nonionic surfactants include the condensation products of alcohols, including guerbet alcohols and guerbet alcohols comprising from 9 to 16 carbon atoms in its alkyl chain and from 2 to 18 moles, or from 2 to 15 moles, or from 5 to 12 of alkylene oxide or ethylene oxide per mole of alcohol. Nonionic surfactants, when present, are comprised in a typical amount of from about 0.1% to about 10%, or about 0.2% to about 8%, or about 0.5% to about 6%, by weight of the composition.

The surfactant system may optionally comprise commercially available cationic surfactants.

Solvent

The composition suitable for the invention may include an organic grease cleaning solvent. An organic grease cleaning solvent, according to the invention, is an organic solvent which, when added to a nil solvent detergent composition comprising between 5 wt. % and 15 wt. % of a surfactant system, improves the oil breakthrough time (vs. the nil solvent detergent composition alone), per the test method described below. A nil solvent detergent composition base matrix may be formulated as shown in Table 2 below.

TABLE 2

| | wt. % |
|---|---|
| Water and minors (preservative, perfume, dye) | To 100 parts |
| Sodium Chloride | 0.4 |
| Sodium bicarbonate | 0.1 |
| Ethanol | 0.34 |
| Polypropylene glycol MW 2000 | 0.05 |
| Glycol Ether solvent | — |
| Mono-ethanolamine | 0.5 |
| L-glutamic acid N,N-diacetic acid, tetra sodium salt | — |
| Alkyl Ethoxy Sulfate (C24EO0.6) | — |
| Alkyl Dimethyl Amine Oxide (C12-14) | 6.67 |
| Non-ionic Alkyl Ethoxylate (C9-11EO8) | 1.33 |
| Xanthan Gum | — |
| pH (10% dilution in demi water) | 10.1 |

Test Method

Oil Preparation

Oil preparation is carried out at ambient temperature of 21° C.+−2° C. All used products should be acclimatized within this temperature range.

Oil 1: A blend of vegetable based cooking oils is achieved by mixing corn oil (Supplier: Vandemoortele—Item: #1001928), peanut oil (Supplier: Vandemoortele—Item: #1002974) and sunflower oil (Supplier: Vandemoortele—Item: #1001926) in equal weight amounts. While mixing, 0.05 wt. % of red dye (Waxoline Red, red dye pigment supplied by Avecia) is added on top. Mixing is continued for 1 hour to achieve a homogeneous dye distribution over the oil sample.

Oil 2: Olive oil (Supplier: Bertoli—Item: #L5313R HO756 MI0002) is mixed with 0.05% of red dye (Waxoline Red, red dye pigment supplied by Avecia) for 1 hour to achieve a homogeneous dye distribution over the oil sample.

Oil 3: Baked oil mix is made by further mixing the resulting oil from Oil 1 with 1% of black dye (Supplier: Sigma-Aldrich. Item: Sudan black B lot MKBQ9075V) for 1 hour to achieve a homogeneous dye distribution. 20 g of the resulting oil mixture is poured homogeneously distributed as a thin layer over a Pyrex™ glass oven tray (from Carrefour L×1=30×24 cm). The tray is oven-baked for 16 hours at 135° C. After baking, the oven tray is put overnight in a humidity cabinet at 25° C. and 70% humidity level. The liquid polymerized oil fraction is then collected in a glass vial and ready for testing.

Procedure 35 grams of a water solution containing 0.15% of xanthan gum (keltrol RD from CP-kelco) is poured onto a glossy white ceramic dish plate (Supplier: Ikea—Item: S.Pryle #13781 diameter 26.5 cm). Then, 2.5 grams of the oil to test is delicately deposited in the middle onto the water surface using a Pasteur pipette (Supplier: VWR—Item: 5 ml #612-1684), thus forming a thin disk of oil layer. The oil disk diameter shall not exceed a variation amongst replicates of more than 20% from the average value. One drop of the detergent sample to test is delicately deposited from a height of less than 5 mm on the middle of the oil disk, using a Pasteur pipette (Supplier: VWR—Item: 5 ml #612-1684). The breakthrough time is the time recorded from the deposition of the solution drop to the opening of the oil disk identified by the apparition of the water layer in the middle of the oil disk. Eight replicates are required per sample (solution type and oil type) to calculate the average breakthrough time for that specific sample/oil combination. The average breakthrough time across the three oil systems (Oil 1, 2, and 3) is calculated and reported for the different test compositions. The lower the breakthrough time the better the cleaning.

The grease cleaning solvent may comprise glycol ethers selected from the group consisting glycol ethers of Formula I, Formula II, and mixtures thereof.

Formula I=R1O(R2O)*n*R3 wherein:

R1 is a linear or branched C4, C5 or C6 alkyl, a substituted or unsubstituted phenyl, preferably n-butyl; Benzyl is one of the substituted phenyls for use herein;

R2 is ethyl or isopropyl, preferably isopropyl;

R3 is hydrogen or methyl, preferably hydrogen;

n is 1, 2 or 3, preferably 1 or 2.

Formula II=R4O(R5O)*n*R6 wherein:

R4 is n-propyl or isopropyl, preferably n-propyl;

R5 is isopropyl;

R6 is hydrogen or methyl, preferably hydrogen;

n is 1, 2 or 3 preferably 1 or 2.

It has been found that these glycol ethers help not only with the product's cleaning speed but also with its cleaning efficacy, especially on greasy soils. This does not seem to happen with glycol ethers, especially not with ethylene glycol and propyleneglycol based glycol ethers, having a different formula than Formula I and Formula II.

Suitable glycol ether solvents can be purchased from The Dow Chemical Company, more particularly from the E-series (ethylene glycol based) Glycol Ethers and the P-series (propylene glycol based) Glycol Ethers line-ups. Suitable glycol ether solvents include Butyl Carbitol, Hexyl Carbitol, Butyl Cellosolve, Hexyl Cellosolve, Butoxytriglycol, Dowanol Eph, Dowanol PnP, Dowanol DPnP, Dowanol PnB, Dowanol DPnB, Dowanol TPnB, Dowanol PPh, and mixtures thereof.

The glycol ether of the product of the invention can boost foaming. The glycol ether solvent typically is present from about 1% to about 10%, or from about 2% to about 8%, or from about 3% to about 7%, by weight of the composition.

An exemplary cleaning composition of the present invention may comprise:

i) from about 5% to about 15%, or from about 7 to about 12%, by weight of the composition, of a surfactant system; and ii) a glycol ether solvent selected from the group consisting of glycol ethers of Formula I: R1O(R2O)nR3, Formula II: R4O(R5O)nR6, and mixtures thereof, wherein:

R1 is a linear or branched C4, C5, or C6 alkyl, or a substituted or unsubstituted phenyl;

R2 is ethyl or isopropyl;

R3 is hydrogen or methyl, and n is 1, 2 or 3;

R4 is n-propyl or isopropyl;

R5 is isopropyl;

R6 is hydrogen or methyl and n is 1, 2 or 3.

The surfactant system and the solvent are in a weight ratio from about 5:1 to about 1:1, or from about 3:1 to about 1:1. Compositions having a surfactant:solvent weight ratio lower than 1:1 do not seem to be able to foam and/or tend to phase separate, creating physical instability in the product. Compositions having a surfactant:solvent weight ratio higher than 5:1 are difficult to spray and are prone to gelling when in contact with greasy soils in the presence of the low levels of water typically present when the product of the invention is used. Gel formation may inhibit the spreading of the composition, impairing cleaning.

Other Optional Ingredients

The composition suitable for the present invention may also comprise other ingredients typically found in cleaning compositions including aminophosphonate or aminocarboxylate chelant, including MGDA or GLDA, builders, and rheology modifying agents such as xanthan gum. The aminocarboxylate chelant not only act as a chelant but also contributes to the reserve alkalinity. This seems to help with the cleaning of cooked-, baked- and burnt-on soils. The composition may also comprise bicarbonate and/or monoethanol and/or carboxylate builders, including citrate builder, that may also contribute to the reserve alkalinity. Other optional ingredients include perfumes, coloring agents, preservatives, solvents, viscosity and pH trimming agents.

The composition for use in the invention may have a pH greater than 8, or from 10 to 12, or from 10.5 to 11.5, as measured at 10% concentration in distilled water at 20° C. The reserve alkalinity of the composition is from about 0.1 to about 1, or from about 0.1 to about 0.5. Reserve alkalinity is herein expressed as grams of NaOH per 100 ml of composition required to titrate the composition at pH 10 to arrive at the pH of the finished composition. The reserve alkalinity for a solution is determined in the following manner. A pH meter (for example an Orion Model 720A) with an Ag/AgCl electrode (for example an Orion sure flow Electrode model 9172BN) is calibrated using standardized pH 7 and pH 10 buffers. A 100 g of a 10% solution in distilled water at 20° C. of the composition to be tested is prepared. The pH of the 10% solution is measured and the 100 g solution is titrated down to pH 10 using a standardized solution of 0.1 N of HCl. The volume of 0.1N HCl required is recorded in ml. The reserve alkalinity is calculated as follows:

Reserve Alkalinity=ml 0.1N HCl×0.1 (equivalent/liter)×Equivalent weight NaOH (g/equivalent)×10.

The pH and reserve alkalinity contribute to the cleaning of tough food soils.

Examples

An exemplary composition suitable for the present invention has a pH from 10 to 11.5 as measured in a 10% solution in distilled water at 20° C., a reserve alkalinity from 0.1 to 0.3 expressed as g NAOH/100 ml of composition at a pH of 10, the composition comprising:

i) from about 4% to about 10%, or from about 5% to about 8%, by weight of the composition, of an alkyl ethoxylate sulfate having an average degree of ethoxylation of about 3;

ii) from about 1% to about 5%, by weight of the composition, of amine oxide surfactant; and iii) from about 3% to about 8%, or from about 4% to about 7%, by weight of the composition, of glycol ether solvent selected from the group consisting of: glycol ethers of Formula I: R1O(R2O)nR3; Formula II: R4O (R5O)nR6; and mixtures thereof. The glycol ether solvent may be dipropylene glycol n-butyl ether.

Another composition suitable for the present invention has a pH of from 10 to 11.5 as measured in a 10% solution in distilled water at 20° C., a reserve alkalinity of from 0.1 to 0.3 expressed as g NAOH/100 ml of composition at a pH of 10, the composition comprising:

i) from about 4% to about 10%, or from about 5% to about 8% by weight of the composition, of a branched short chain sulfate, preferably 2-ethyl hexyl sulfate, ii) from about 1% to about 5% by weight of the composition of amine oxide surfactant; and iii) from about 3% to about 8%, or from about 4 to about 7% by weight of the composition of glycol ether solvent selected from the group consisting of glycol ethers of Formula I: R1O(R2O)nR3, Formula II: R4O (R5O)nR6 and mixtures thereof, preferably dipropylene glycol n-butyl ether.

Another exemplary composition has a pH of from 10 to 11.5 as measured in a 10% solution in distilled water at 20° C., a reserve alkalinity of from 0.1 to 0.3 expressed as g NAOH/100 ml of composition at a pH of 10, the composition comprising:

i) at least about 5%, or from about 6% to about 15%, by weight of the composition, of a surfactant system comprising:

a. about 60% to about 90%, by weight of the surfactant system, of a primary surfactant selected from the group consisting of amphoteric surfactant, zwitterionic surfactant and mixtures thereof; preferably the primary surfactant is selected from the group consisting of amine oxide, betaines and mixtures thereof, or amine oxide;

b. about 10 to about 40%, by weight of the surfactant system, of a co-surfactant selected from non-ionic surfactant, anionic surfactant, and mixtures thereof; and ii) from about 3% to about 8%, or from about 4% to about 7%, by weight of the composition, of glycol ether solvent selected from the group consisting of glycol ethers of Formula I: R1O(R2O)nR3, Formula II: R4O (R5O)nR6 and mixtures thereof, or dipropylene glycol n-butyl ether.

Another exemplary composition has a pH of from 10 to 11.5 as measured in a 10% solution in distilled water at 20° C., a reserve alkalinity of from 0.1 to 0.3 expressed as g NAOH/100 ml of composition at a pH of 10, the composition comprising:

i) about 5% to about 15%, by weight of the composition, of a surfactant system, the surfactant system comprising:

a. about 40% to 90%, or about 55% to about 75% by weight of the surfactant system, of a non-ionic surfactant;

b. about 10% to about 60%, or about 25% to about 45%, by weight of the surfactant system, of a co-surfactant selected from anionic surfactant, amphoteric surfactant, zwitteronic surfactant, and mixtures thereof;

ii) from about 3% to about 8%, or from about 4% to about 7%, by weight of the composition, of glycol ether solvent selected from the group consisting of glycol ethers of Formula I: R1O(R2O)nR3, Formula II: R4O (R5O)nR6 and mixtures thereof, preferably dipropylene glycol n-butyl ether.

Foam Product

The described levels of surfactants, specific solvents, and the surfactant:solvent weight ratio provide flash suds and long lasting suds. This also provides a direct-foam product with good surface area coverage, especially when combined with a suitable dispenser system, preferably a pre-compression trigger sprayer according to the sprayer disclosed herein, thereby improving cleaning efficiency. The physical characteristics of the direct-foam of the present invention include a certain compression force, central and ring area size, foam density, and foam bounce back.

The direct-foam cleaning product of the present invention comprises a foam compression force that provides an optimum balance of surface area coverage for efficient cleaning and minimal bounce back for minimal lost chemistry. The compression force of the direct-foam cleaning product of the present invention is about 2.4 gf*mm to about 4.3 gf*mm, alternatively about 2.5 gf*mm to about 4.0 gf*mm, or about 3.0 gf*mm to about 4.0 gf*mm, or about 3.1 to 3.8 gf*mm "gf*mm", as used herein, is gram-force multiplied by millimeter. The direct-foam product has longevity compression force wherein at least 90%, or at least 95%, of the initial foam compression force is maintained for 5 minutes. While not wishing to be bound by theory, a compression force higher than about 4.3 gf*mm results in a consumer unacceptable dense/sticky foam that covers a small surface area requiring multiple spray strokes by the user for good product coverage on a target surface. The foam density of the direct-foam product may have an average foam density from about 0.08 g/ml to about 0.3 g/ml, or from about 0.09 g/ml to about 0.2 g/ml, or from about 0.10 g/ml to about 0.15 g/ml. A low compression value results in a consumer unacceptable watery/airy foam which leads to higher bounce back levels (i.e. when the foam product hits the target surface, it bounces back and, as such, a certain amount of chemistry is lost from the cleaning area, spoiling the surrounding area and potentially contributing to inhalation risk). The bounce back level of the direct-foam product, when sprayed from a spray dispenser, may be less than about 500 mg, or less than about 200 mg, or less than about 80 mg. The direct-foam product comprises a plurality of bubbles having a mean bubble size from about 200 μm to about 400 μm. Using the Mean Bubble Size test method described herein, the Method product provides a mean bubble size of about 171 μm. The Test Product, according to the present invention, using the Test Product composition described herein in Table 5 and the Spray Dispenser Type 2 described in Table 6, provides a mean bubble size of about 245 μm.

The direct-foam product of the present invention has a foam pattern that is defined by the central area, ring, area, and/or overall area as determined in the Foam Pattern Test Method outlined below. The central area of the foam pattern measures from about 30 $cm^2$ to about 60 $cm^2$, or from about 30 $cm^2$ to about 45 $cm^2$, or from about 35 $cm^2$ to about 45 $cm^2$; and an overall or total area of foam measuring from about 20 $cm^2$ to about 90 $cm^2$, or from about 60 $cm^2$ to about 80 $cm^2$, or from about 50 $cm^2$ to about 75 $cm^2$. The foam in the ring area covers about 1 $cm^2$ to about 20 $cm^2$, or about 10 $cm^2$ to about 20 $cm^2$.

Test Methods

For the purposes of testing to determine characteristics of the composition, such as: Compression Force, Longevity Compression Force, Foam Density, Foam Pattern (includes Ring Area and Central Area), Bounce Back, and Spray Particle Distribution in specified areas, the targeted product (i.e. composition and accompanying spray device) is used to spray the composition to generate direct-foam samples to be tested.

Compression Force Test Method

The characteristic defined herein as the Compression Force is measured on samples of foam generated from the cleaning composition and spray device being tested. The compression force of a direct-foam composition may be measured by the following test method.

- A texture analyzer (model TA.XT plus) is provided by Stable Micro Systems Ltd. (Godalming, Surrey, UK). The data is analyzed by Texture Exponent software (Version 6.0, Build 6, Issue 0) also provided by Stable Micro Systems Ltd. For purposes of this testing, the instrument is configured with an aluminum probe having a cylindrical shape with smooth surfaces. The bottom surface of the probe has a diameter of 22 mm; the probe height is 3 mm
- A foam sample is collected in a 100 ml polypropylene conical titration container with an upper inside diameter of 5.2 cm, a bottom inside diameter of 3.2 cm and a height of 9.0 cm, (container series #101974) available from Mettler-Toledo International Inc. (Columbus, Ohio, U.S.A.). To collect the foam sample, the nozzle of the spray dispenser is placed at the top edge of the conical titration container and sprayed downwards towards the inside bottom of the container. Spraying is continuously repeated, with full actuation and release of the trigger for each spray and no waiting time after each stream of spray ends, until the total volume of the foam product inside the conical titration container is about 40 ml, including the foam and the liquid drainage from the foam.
- Measurements of compression force vs. compression time are performed immediately after the foam is generated, following the macro setting shown in Table 3. The compression work is calculated as the integration of normal force times distance when the probe is going down in the unit of gf*mm following Table 4.
- The following sequence and macro setting is programmed on the instrument to conduct the measurement.

TABLE 3

| N | Caption | Value | Type | Comment | Display condition |
|---|---|---|---|---|---|
| 0 | <reserved> | 0 | <reserved> | | Never |
| 1 | Tension/ compression | 1 = compression | List | Used to set tension/ compression mode | Always |
| 2 | | 10 mm/sec | Speed | Used for stage 3/stage 8 | Never |
| 3 | | 0.5 g | Force | Used for stage 3 | Never |
| 4 | | 0.5 mm/sec | Speed | Used for stage 5 | Never |
| 5 | | 3 mm | Distance | Used for stage 5 | Never |
| 6 | | 1 sec | Time | Used for stage 6 | Never |
| 7 | | 1 mm/sec | Speed | Used for stage 7 | Never |
| 8 . . . 245 | | N/A | <spare> | | Never |
| 246 | | 0 mm | Distance | Used for position memory 2 | Never |
| 247 | | 0 mm | Distance | Used for position memory 1 | Never |
| 248 | | 0 | Miscellaneous | Used for temporary register | Never |
| 249 | | 0 | Miscellaneous | Used for temporary register | Never |

Figure 6:
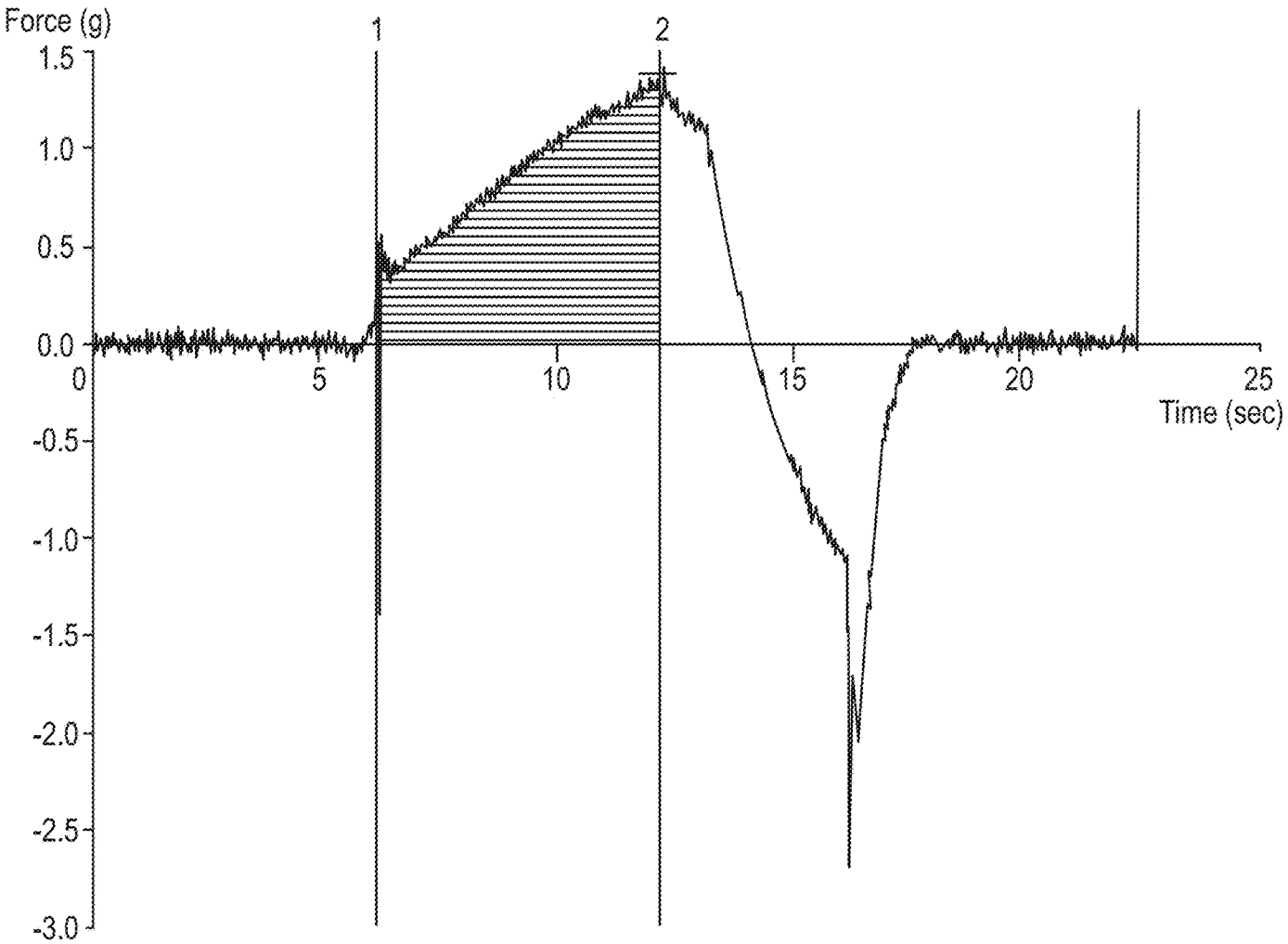
FIG. 6 is a graphical representation of compression forces for a direct-foam spray.

- The following sequence and macro setting is programmed on the instrument to conduct the analysis. The force area between two time points is calculated (see FIG. 6, Compression Force area calculation).

TABLE 4

| | Program | Flags |
|---|---|---|
| 1 | Clear graph results | |
| 2 | Redraw | |
| 3 | Search Forwards | |
| 4 | Go to time 5 seconds | |
| 5 | Go to force 0.2 g | |
| 6 | Drop anchor | |
| 7 | Go to peak + ve value distance | |
| 8 | Drop anchor | |
| 9 | Area (Active vs Active) | R |

The Compression Force test method is conducted in triplicate for each product being tested, in a room having an air temperature of 23+/−2° C. and 50%+/−10% relative humidity ("RH"), while being protected from air currents. The reported Compression Force of a product is the average value from the replicate samples tested.

Longevity Compression Force Test Method:

The characteristic defined herein as "Longevity Compression Force" is measured on samples of foam generated from the cleaning product being tested. This test is conducted following all the instructions provided above for the Compression Force test method, with the following modification: an additional 5 minute time interval is inserted between the time points of immediately after the foam is generated and 5 minutes after the foam is generated. The end result is reported as the Longevity Compression Force.

Foam Density Test Method

The characteristic defined herein as the "Foam Density" is measured on samples of foam generated from the cleaning product being tested.

- The test is performed at an ambient temperature of 21° C.+/−2° C. and a RH of 40% to 60%, while being protected from air currents.
- A foam sample is collected in a 250 ml glass beaker having a 200 ml volume mark.
- The weight of the glass beaker is measured and recorded prior to the test.
- To collect the foam product sample, the sprayer nozzle of the dispenser containing the product is placed in contact with and at the top edge of the glass beaker. The composition is sprayed downwards into the bottom of the glass beaker. With the help of a timer, the composition is sprayed downwards at a pace of two sprays per second until the height of the sprayed foam product in the beaker reaches the 200 ml volume mark. The combined weight of the beaker and the foam product is immediately measured, and the initial beaker weight is subtracted to determine the weight of the foam product therein.
- The foam density is calculated as the weight of the foam product within the beaker (in grams) divided by 200 ml.
- The test is repeated in triplicate and the average value from the three replicates is reported as the Foam Density, in units of g/ml.

Foam Pattern Test Method

The Foam Pattern test method measures the reflection of light through the specific area where foam is sprayed. A grayscale light reflection image is obtained using a flatbed scanner (A suitable scanner is Epson™ Scanner Perfection V370) with document scan model. Distilled water (fresh prepared by water purifier, resistivity as 18.2 MΩ·cm at 25° C., e.g. prepared by Milli-Q® Integral with Q-POD® and E-POD® dispensers, Merck KGaA, Germany) is used to calibrate the light reflection. This enables the boundary of the foam pattern to be identified for the area calculations. The Ring Area and the Central Area are used to define the foam pattern

Figure 1C:
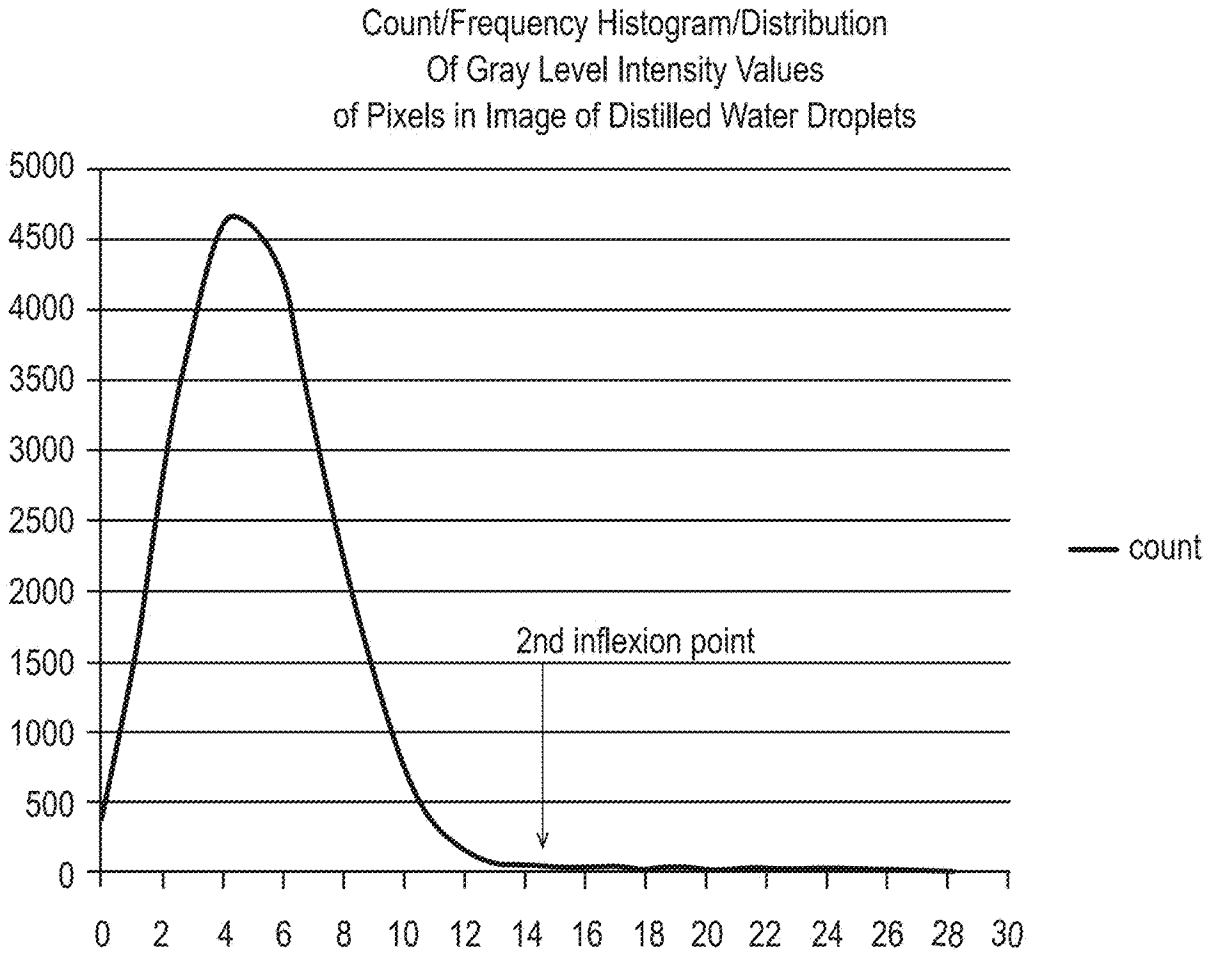
FIG. 1C is a graph showing the distribution of the gray level intensity value of distilled water droplets in a scanned image for use as a calibration standard in the Foam Pattern test method according to the present invention.

- Place scanner in a dark room (ensure no light is present during the scanning process). Turn on the scanner for 30 minutes prior to any test. Drop 0.1 ml of distilled water on the glass plate of the scanner and ensure it is a minimum of 5 cm away from the foam sample spray area. Distilled water is used as an internal standard for light reflection calibration.
- Hold the sprayer and keep the linear distance between the sprayer nozzle and the glass plate of the scanner at 11 cm. Apply one spray of foam on the glass plate of the scanner and ensure the general spray trajectory of the foam during the spray is vertical and perpendicular to the glass plate.
- The foam pattern is scanned immediately into an 8 bit grayscale tif image (1654*2338 in dimension) at 200 dpi.
- Images are analyzed by MATLAB (Version 2014b) with Image Processing Toolbox from MATHWORKS (Natick, Mass., U.S.A). The outputs include Central Area ("A1" in FIG. 1A), Overall Area ("A2" in FIG. 1B), and Ring Area (A2 minus A1).
- Key steps of image analysis to obtain the above outputs are listed as follows (using FIGS. 1A and 1B as references):
  - Foam blobs are identified with a binary version of the original grayscale image. A foam blob is a collection of individual small bubbles connected with each other.
  - The binary image is created by using a threshold value that is derived from the image of the internal standard distilled water droplet. The threshold value is defined as being double the grey level intensity value that occurs at the $2^{nd}$ inflexion in the histogram distribution curve of grey level intensity values from the distilled water droplet image (as shown in FIG. 1C). The $2^{nd}$ inflexion point is likely located slightly below the maximum grey level intensity value found in the water droplet image. After applying the threshold value, the resulting binary image is run through an open and close operation with disk radius of 2 pixels, and all holes filled up in order to identify all the foam blobs in the image.
  - Identify the Central Area of the spray pattern by identifying all the blobs of the foam sample and their area. The biggest contiguous blob of the foam sample is defined as the Central Area (A1 as shown in FIG. 1A). Report the size of the Central Area (A1).
  - Identify the outer edge of the Overall Foam Area (A2 as shown in FIG. 1B; includes the Central Area and the Ring Area) by running an image close operation with disk radius of 20 pixels then identifying blobs. The edge of the biggest blob is defined as the edge of the Overall Foam Area (A2). Calculate the area covered by foam within the Overall Area.
  - The area between the edge of Central Area and the outer edge of the Overall Foam Area is defined as Ring Area (ie. Area A1 subtracted from Area A2). Calculate the area covered by foam within the Ring Area by subtracting the Central Area from the Overall Area or by identifying all foam blobs within the Ring Area and calculating the sum of those areas. Also count the number of individual blobs within the ring area.
- The test is repeated in triplicate and the average value from the three replicates is reported for each parameter measured, including the Central Area, the Ring Area and Overall Area covered by foam in units of $cm^2$.

Figure 7:
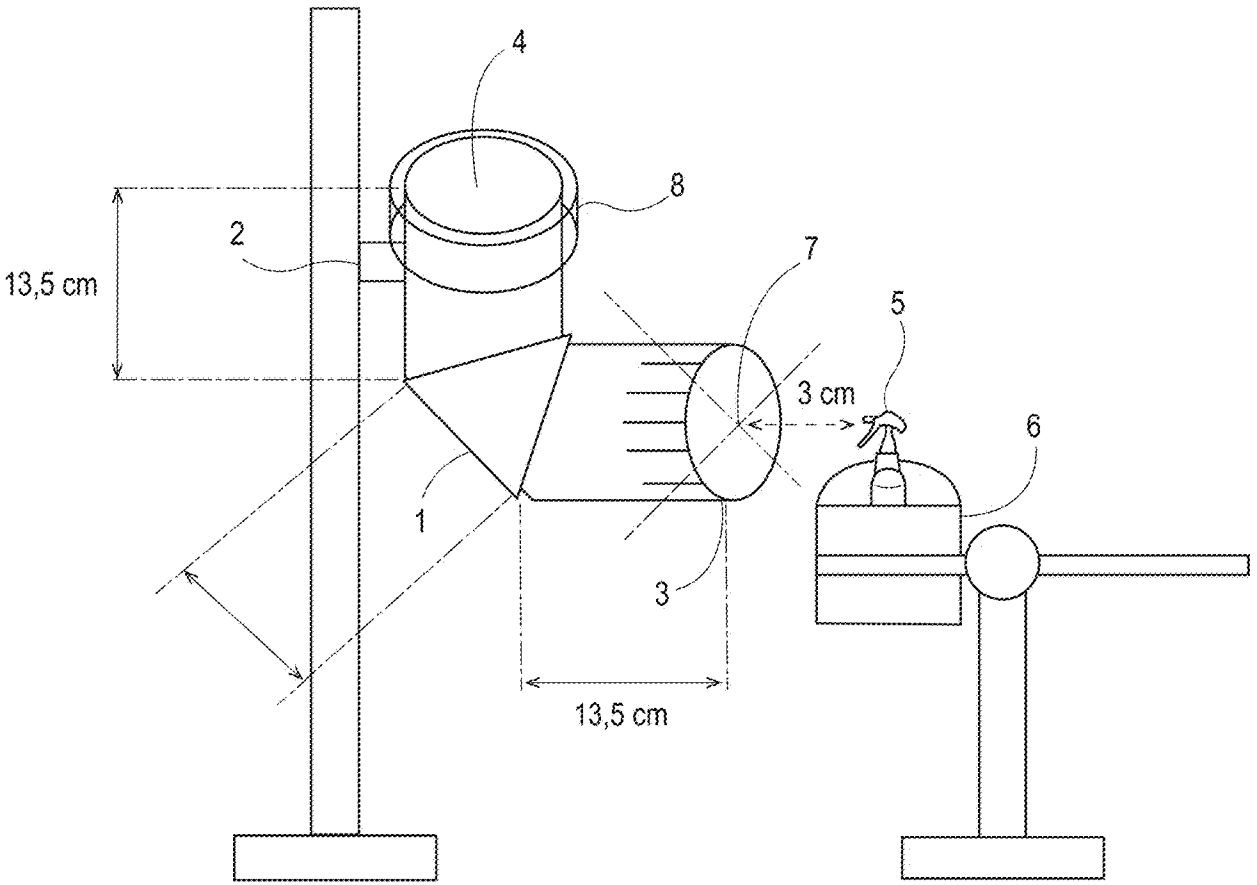
FIG. 7 is a pictoral representation of an apparatus used in a bounce back test method.

Bounce Back Test Method:

Bounce Back is assessed by means of gravimetrical measurement of captured foam product. Referring to FIG. 7, a pipe bend is provided comprising a thin steel metal pipe of approximately 130 mm internal diameter and having a 90° bend centered along its length. The reference numerals in FIG. 7 are enclosed in parentheses in this method description. The outer side (1) of the pipe bend is comprised of a single flat plane of metal located at a 45° angle relative to the two adjacent un-bent regions of the pipe, each un-bent region has a length of approximately 13.5 cm. Suitable pipe bends may include unpainted metal flue pipes commonly used for stoves and fireplaces. One suitable pipe bend (Article 11165, Bocht RVS 90°, Ø: 130 mm, kleur: onbewerkt) is purchased from Kuijt Kachels & Haarden (Katwijk, The Netherlands). The pipe bend is put in a secure position (2) with the ribbed end opening (3) perpendicular to the ground and the non-ribbed end opening (4) water level and facing upwards. A trigger sprayer (5) is locked onto a holder (6) to maintain the position of the trigger sprayer nozzle relative to the ribbed end opening (3) of the pipe bend. The nozzle is centered (7) with the ribbed end opening (3) and placed at a distance of 3 cm from the ribbed-end opening. To capture the portion of the sprayed composition that is bounces back up the pipe bend, the lid (8) of a plastic petri dish and lid set is used (such as VWR item number 391-1501, diameter: 140 mm) The lid (8) is the portion of the set that has the smallest diameter and largest depth. The lid (8) is placed on an analytical balance (Mettler-Toledo AG204 or equivalent) and the weight is set at zero. The lid (8) is then placed over the opening of the non-ribbed end opening (4), with the bottom and side walls of the lid (8) capping the non-ribbed end opening of the pipe bend (i.e. the side walls of the lid overlap the side walls of the pipe bend).

- The Bounce Back test is performed at ambient temperature of 21° C.+/−2° C. Ventilation and air currents are minimized in the room and the test device is protected from such currents.
- With the help of a timer, product is sprayed thirty times at a pace of one spray per second. The one spray per second pace is maintained regardless of whether a particular spray stream continues longer than 1 second. Further, where a spray dispenser requires priming to initiate the product being dispensed as a spray, such priming step precedes the start of this spraying step.
- Within ten seconds after the last spray, the captured product on the lid is weighted with the analytical balance. This is done by lifting the petri dish lid from the pipe, flipping it to avoid product falling off, and transferring to the analytical balance. The weight of the foam product captured on the petri lid is recorded to the nearest unit number of a milligram (e.g. 5 mg, 107 mg, etc.).
- The measurement is repeated three times to control variation. In between every replicate the pipe bend is cleaned with water and ethanol and dried. For every replicate measurement, a new petri dish lid is used.
- The Bounce Back value reported is the average value of the three captured composition weights measured from the replicates, reported in units of mg.

Mean Bubble Size Test Method

The characteristic defined herein as "Mean Bubble Size" is measured on samples of foam generated from the cleaning composition being tested. Mean bubble size is defined as the average diameter of individual bubbles, calculated by the frequency weighted mean. A microscopy system called Olympus™ BX51 is used to take the foam image. Image-Pro Plus 5.0 (from Media Cybernetics) is used to measure the diameter of bubbles. JMP® Pro 11 (from SAS) is used for statistic analysis on the data.

A glass slide without any coating (Corning® Micro slide, 2949-75x50, thickness: 0.96 to to 1.06 mm) is used for sample prep, as normally used for microscopy. The distance from the sprayer nozzle to the glass slide is around 5 cm to 10 cm. For every spray, five different locations are randomly picked to take the microscopy images. For each sample, five sprays are conducted to get collective images for bubble size measurement and analysis. Four times of magnitude is used. For every single bubble, the inner diameter is used for the calculation. The foam film thickness is not included in the calculation. For one product, the average of bubble sizes and its distribution are based on the data collection on twenty-five images.

Examples

Certain physical parameters of the direct-foam product (e.g. compression force, foam density, central area and ring area and bounce back measurements) were taken on two comparative products and one test product according to Table 5.

TABLE 5

| Type of product | Test Product | Comparative Product 1 | Comparative Product 2: Method Power Foam Lemon Mint |
|---|---|---|---|
| ID | | | Bottle code: 14205A |
| Spray bottle type | 1 | 2 | Method market bottle |
| Water | To 100 parts | To 100 parts | |
| Sodium Chloride | 0.4 | — | |
| Sodium bicarbonate | 0.1 | 0.1 | |
| Ethanol | 0.34 | 0.34 | |
| Polypropylene glycol | 0.05 | 0.05 | |
| DPnB Glycol Ether | 5 | 5 | |
| Mono-ethanolamine | 0.5 | 0.5 | |
| L-glutamic acid N,N-diacetic acid, tetra sodium salt | — | 1 | |
| Alkyl Ethoxy Sulphate (C24EO3) | — | 8 | |
| Alkyl Dimethyl Amine Oxide (C12-14) | 6.67 | 1 | |
| Non-ionic Alkyl Ethoxylate (C9-11EO8) | 1.33 | — | |
| 2-Methyl-4-isothiazolin-3-one | 0.01 | 0.01 | |
| Phenoxyethanol | 0.30 | 0.30 | |
| Perfume | 0.17 | 0.17 | |

Spray Dispenser Types 1 and 2 are constructed per the descriptions in Table 6.

TABLE 6

| | Orifice size | External cone angle | Number of spin grooves in nozzle | Groove width | Buffer pressure |
|---|---|---|---|---|---|
| Spray Dispenser Type 1 (47) | 0.36 cm | 100° | 3 | 0.25 cm | ~4.3 |

TABLE 6-continued

| | Orifice size | External cone angle | Number of spin grooves in nozzle | Groove width | Buffer pressure |
|---|---|---|---|---|---|
| Spray Dispenser Type 2 (49) | 0.32 cm | 80° | 5 | 0.2 cm | ~4.3 |

Results are tabulated in Table 7.

TABLE 7

| | Compression Force (gf * mm) [standard deviation (gf * mm)] | Foam Density (g/ml) | Central Area [standard deviation] | Overall Area [standard deviation] | Ring Area [standard deviation] | Number of blobs in ring area [standard deviation] | Bounce Back (mg) |
|---|---|---|---|---|---|---|---|
| Comparative Product 1 (49) | 2.24 [0.15] | 0.34 | 34 $cm^2$ [3.0 $cm^2$] | 58 $cm^2$ [5.7 $cm^2$] | 8.7 $cm^2$ [1.1 $cm^2$] | 653 [74] | 578 |
| Comparative Product 2 (Method product) | 4.48 [0.24] | 0.07 | 19 $cm^2$ [1.1 $cm^2$] | 2.0 $cm^2$ [0.23 $cm^2$] | 0.10 $cm^2$ [0.004 $cm^2$] | 28 [2] | 0 |
| Test Product (47) | 3.71 [0.15] | 0.11 | 42 $cm^2$ [3.0 $cm^2$] | 65 $cm^2$ [6.1 $cm^2$] | 15 $cm^2$ [1.5 $cm^2$] | 946 [52] | 76 |

Comparative Product 1 has a compression force below the desired compression force range, suffering from a high amount of bounce back product upon spraying and leading to product loss, messiness around the work space. This may also create product inhalation concerns with the consumer.

Comparative Product 2 has a compression force above the desired compression force range and suffers from a too low surface area coverage per spray, requiring consumers to spray multiple times to cover the desired surface area.

The Test Product according to the present invention has compression value within the desired range and demonstrates large surface area coverage with minimal product bounce back levels. Without wishing to be bound by theory, products with high compression force possess a very solid sticky foam pattern, inhibiting the foam to separate over the desired surface area, leading to a small area covered accordingly. Due to this solid sticky nature these foams tend to demonstrate very slow collapsing behavior upon spraying, as demonstrated by their low foam density value, i.e. limited sprays required to achieve 200 ml total product volume in foam density test. Products with a very low compression force possess a more airy and watery and less sticky foam pattern, leading to parts of the foam to be easily bounced back from the surface and the remainder of the foam, as demonstrated by their high foam density values, i.e. due to the low sticky nature of these foams they tend to collapse easily upon spraying, leading to a higher number of sprays requirement to meet a fixed product volume, and as such to a higher foam density value within the foam density test described herein.

Figure 8:
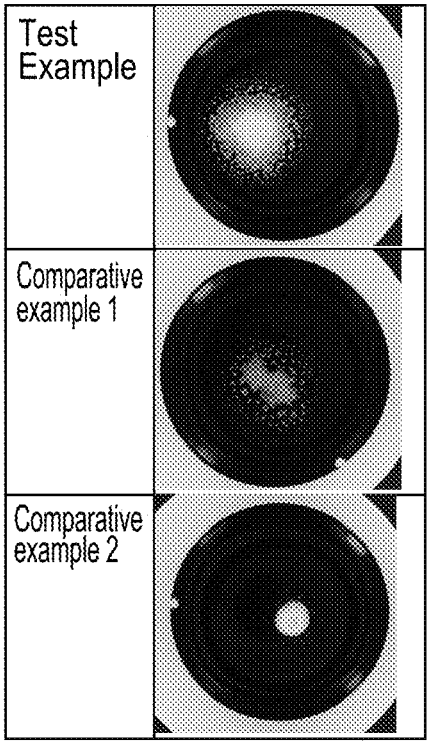
FIG. 8 shows photographs of spray patterns of different direct-foam cleaning products.

FIG. 8 show images of the direct-foam composition sprayed on a black ceramic plate from the same distance using the Comparative Products and Test Product. It can be seen that compression value is correlated with a good spray pattern and coverage area. However, too high of a compression value, such as that shown by the Comparative Product 2 foam, gives a very dense sticky foam covering a small area which will require the user spray the product multiple times to get a surface covered. Too low of a compression value gives a low density airy foam which leads to undesirable levels of bounce back (i.e. when the foamed spray hits the surface it bounces back and as such a certain amount of chemistry is lost from the cleaning area and spoiling the surrounding area. One can see that the direct-foam composition having the compression force of the present invention provides an optimum balance between delivering sufficient surface area coverage while controlling amount of bounced back (e.g. lost chemistry).

All percentages stated herein are by weight unless otherwise specified. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Further, it should be understood that every maximum numerical limitation given throughout this specification will include every lower numerical limitation, as if such lower numerical limitations were expressly written herein. Likewise, every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A direct-foam cleaning product comprising a cleaning composition comprising:

a) from about 5% to about 15%, by weight of said composition, of a surfactant system, wherein said surfactant system comprises:

i) a branched alkyl or branched alkyl ether sulfate anionic surfactant; and ii) a co-surfactant selected from the group consisting of amphoteric surfactants, zwitterionic surfactants, and mixtures thereof, wherein said anionic surfactant and said co-surfactant are present in a weight ratio of about 4:1 to about 1:1; and b) from about 1% to about 10%, by weight of said composition, of a grease cleaning glycol ether solvent selected from the group consisting of:

1) glycol ethers of Formula R1O(R2O)nR3; and 2) glycol ethers of Formula II: R4O(R5O)mR6; and mixtures thereof: wherein R1 is a linear or branched C4, C5 or C6 alkyl or a substituted unsubstituted phenyl, R2 is ethyl or isopropyl, R3 is hydrogen or methyl and n is 1, 2 or 3, R4 is n-propyl or isopropyl, R5 is isopropyl, R6 is hydrogen or methyl and m=1, 2 or 3, and wherein said surfactant system and said glycol ether solvent are present in said composition in a weight ratio from about 5:1 to about 1:1; and wherein said cleaning composition is formulated to provide a foam when dispensed from a spray dispenser, and wherein said foam comprises a compression force from about 2.4 gf*mm to about 4.3 gf*mm.

2. The direct-foam cleaning product of claim 1, wherein said foam comprises an average foam density of about 0.08 g/ml to about 0.3 g/ml.

3. The direct-foam cleaning product of claim 1, wherein said foam comprises a plurality of bubbles having a mean bubble size from about 200 μm to about 400 μm.

4. The direct-foam cleaning product of claim 1, wherein said foam defines an overall area from about 20 $cm^2$ to about 90 $cm^2$ and a central area from about 30 $cm^2$ to about 60 $cm^2$.

5. The direct-foam cleaning product of claim 1, wherein said composition, when sprayed from a spray dispenser, provides a bounce back value of less than about 500 mg.

6. The direct-foam cleaning product of claim 1, wherein at least 90% of the initial foam compression force is maintained for at least 5 minutes.

7. The direct-foam cleaning product of claim 1, wherein said foam is dispensed from a pre-compression trigger sprayer having a buffer pressure of about 3 to about 5.5 bar.

8. The direct-foam cleaning product of claim 7, wherein said pre-compression trigger sprayer comprises a nozzle having 3 to 5 spin grooves.

9. The direct-foam cleaning product of claim 1, wherein said product is a hand dishwashing detergent product.

* * * * *